US010598462B2

(12) United States Patent
Tedder et al.

(10) Patent No.: US 10,598,462 B2
(45) Date of Patent: Mar. 24, 2020

(54) POCKET HOLSTER

(71) Applicant: Tedder Industries, LLC, Post Falls, ID (US)

(72) Inventors: Thomas Tedder, Post Falls, ID (US); Taylor Vold, Valleyford, WA (US)

( * ) Notice: Subject to any disclaimer, the term of this patent is extended or adjusted under 35 U.S.C. 154(b) by 0 days.

(21) Appl. No.: 16/271,700

(22) Filed: Feb. 8, 2019

(65) Prior Publication Data

US 2019/0249950 A1 Aug. 15, 2019

Related U.S. Application Data

(60) Provisional application No. 62/631,430, filed on Feb. 15, 2018.

(51) Int. Cl.
*F41C 33/00* (2006.01)
*F41C 33/04* (2006.01)
*F41C 33/02* (2006.01)

(52) U.S. Cl.
CPC ..... *F41C 33/048* (2013.01); *F41C 33/0209* (2013.01); *F41C 33/0263* (2013.01); *F41C 33/041* (2013.01)

(58) Field of Classification Search
CPC ..... F41C 33/048; F41C 33/0209; F41C 33/0263; F41C 33/041
USPC ..... 224/230
See application file for complete search history.

(56) References Cited

U.S. PATENT DOCUMENTS

| | | | | | |
|---|---|---|---|---|---|
| 4,387,523 | A * | 6/1983 | Gallagher | F41C 33/0209 | 42/1.09 |
| 4,741,465 | A * | 5/1988 | Johnson | F41C 33/0209 | 224/230 |
| 5,150,825 | A * | 9/1992 | Nichols | F41C 33/0209 | 224/242 |
| 5,209,383 | A * | 5/1993 | Theodore | F41C 33/0227 | 224/193 |
| 2015/0184978 | A1* | 7/2015 | Hedeen | F41G 1/35 | 42/114 |
| 2015/0192387 | A1* | 7/2015 | Thompson | F41C 33/0209 | 224/243 |
| 2016/0209165 | A1* | 7/2016 | Karcher | F41C 33/048 | |
| 2018/0224240 | A1* | 8/2018 | Sereday | F41C 33/0254 | |
| 2019/0072361 | A1* | 3/2019 | Toschi | F41C 33/029 | |
| 2019/0120592 | A1* | 4/2019 | Yeates | F41C 33/0263 | |
| 2019/0178609 | A1* | 6/2019 | Horlacher | F41C 33/0209 | |
| 2019/0219357 | A1* | 7/2019 | Ryckman | F41C 33/0209 | |
| 2019/0219358 | A1* | 7/2019 | Rogers | F41C 33/0209 | |
| 2019/0257617 | A1* | 8/2019 | Sereday | F41C 33/0209 | |
| 2019/0293386 | A1* | 9/2019 | Smith | F41C 33/041 | |
| 2019/0316876 | A1* | 10/2019 | Zhang | A45F 5/021 | |

* cited by examiner

*Primary Examiner* — Peter N Helvey
(74) *Attorney, Agent, or Firm* — Timberline Patent Law Group

(57) ABSTRACT

A pocket holster assembly is used to support and to carry an implement in a user's pocket. The pocket holster assembly includes a hook catch arranged to catch on the user's pocket to prevent the pocket holster assembly from being removed from the pocket with the implement. A concealer hook camouflages the shape of the pocket holster and the implement while in the pocket.

20 Claims, 10 Drawing Sheets

POCKET HOLSTER

PRIORITY CLAIM AND CROSS-REFERENCE TO RELATED APPLICATION

This application claims the benefit under 35 U.S.C. § 119(e)(1) of U.S. Provisional Application No. 62/631,430, filed Feb. 15, 2018, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

At times it can be desirable to carry an implement such as a handgun in a pocket of a user's clothing. However, when doing so, it is still desirable to have a holster that provides a high level of protection to the user and also to the handgun. Currently available holsters designed for pocket use are not always as robust and convenient to use, while fitting within the user's pocket. Additionally, it can be undesirable in many cases for the holster or the handgun to show through the pocket, especially when the user desires to conceal the presence of the handgun in the pocket.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
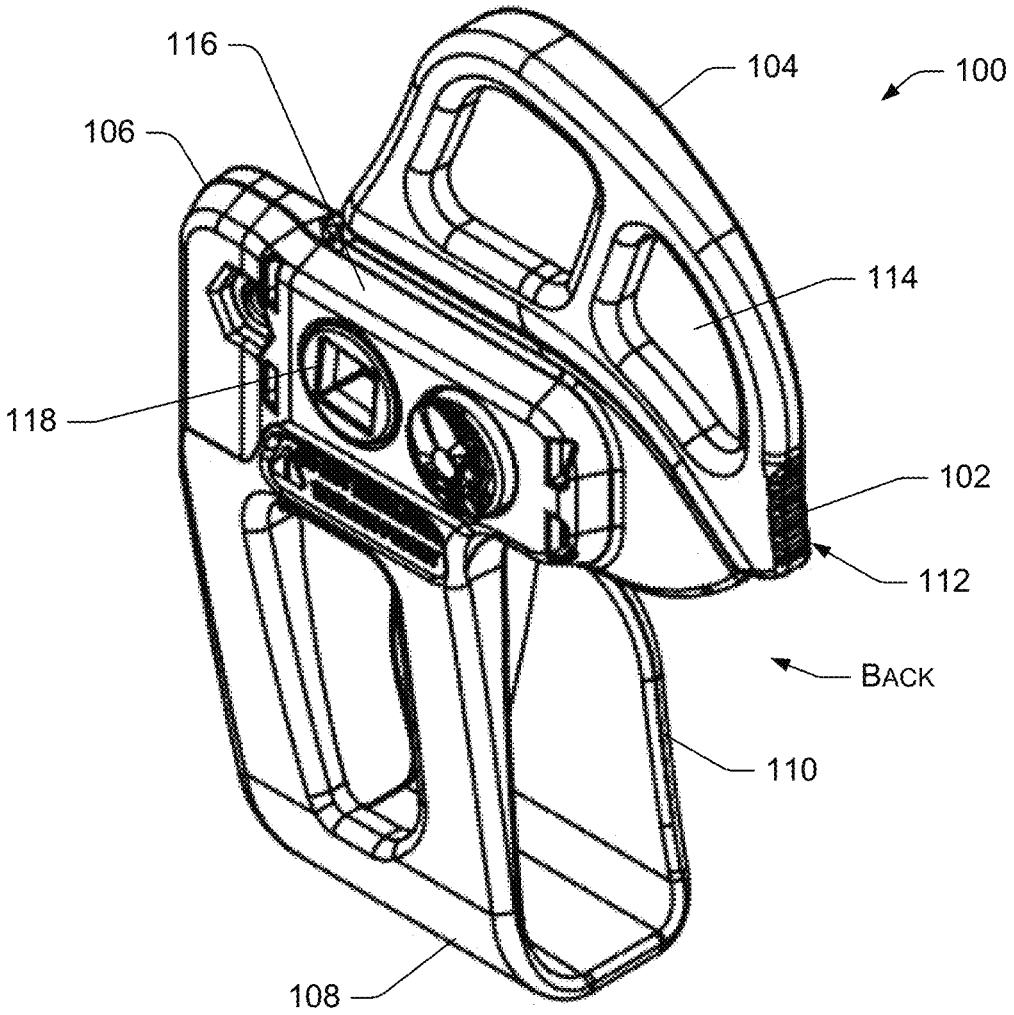
FIG. 1 shows a perspective view of an example pocket holster assembly, according to an embodiment.

Representative implementations of devices and techniques provide a pocket holster assembly 100 to support and to carry an implement (such as a handgun, for example) in a pocket (or the like) of a user. The pocket holster assembly 100 is arranged to be worn in a pocket of a user's clothing or within a user's accessories for temporarily and safely carrying the implement, while making the implement easily accessible to the user. For instance, it can be worn in a pocket of a user's pants, coat, shirt, purse, bag, or the like. It can also be worn on another part of a user's person, or can be used to support an implement or implement holster in another location not on a user.

In various embodiments, the pocket holster assembly 100 ("assembly 100") can be used with or without a holster (such as a holster shell, for example) coupled to the assembly 100. Using the assembly 100 with a holster or holster shell can add to the protection to the user and to the implement while carrying the implement, as discussed further below. In various examples, a variety of holsters or holster shells may be temporarily or permanently coupled to the assembly 100, to accommodate a variety of implements (e.g., handguns, etc.).

For instance, a variety of holsters or holster shells may be removably coupled to an assembly 100 to carry different implements with the assembly 100. One holster shell may be user-removed from the assembly 100, and another holster shell user-installed onto the assembly 100 when the user desires to use the assembly 100 with a different handgun, for example. In one implementation, a selection of modular holster shells may be interchangeable with each other for coupling to the assembly 100, including holster shells configured for specific implements as well as generic holster shells that may fit a variety of implements.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, sheaths, containers, implements, tools, objects, and the like, and remain within the scope of the disclosure. For the purposes of this disclosure, the generic term "carrier" is used to indicate any or all of the above.

Additionally, the techniques and devices as discussed may be used to support an implement or a carrier in various other manners (e.g., attached to a vehicle, an object of furniture, another object, etc.). In alternate implementations, the techniques and devices may be employed in other ways or with other devices, systems, instruments, or the like.

Further, the shape and quantity of the assembly 100 components illustrated in the figures may vary to accommodate various applications. In alternate embodiments, fewer, additional, or alternate components may be used and/or combined to form an assembly 100 or a pocket holster system having equivalent function and operation.

Implementations are explained in more detail below using a plurality of examples. Although various implementations and examples are discussed here and below, further implementations and examples may be possible by combining the features and elements of individual implementations and examples.

Example Embodiments

FIGS. 1-21 illustrate example embodiments of a pocket holster assembly 100 for an implement (such as a handgun, for example), in various non-limiting configurations. The illustrations of the components of the assembly 100 and the various carriers 1000 as shown in FIGS. 1-21 are not intended to be restrictive, and the components may have other shapes, dimensions, orientations, and so forth, while performing the functions (or equivalent functions) described herein, and without departing from the scope of the disclosure.

Figure 20:
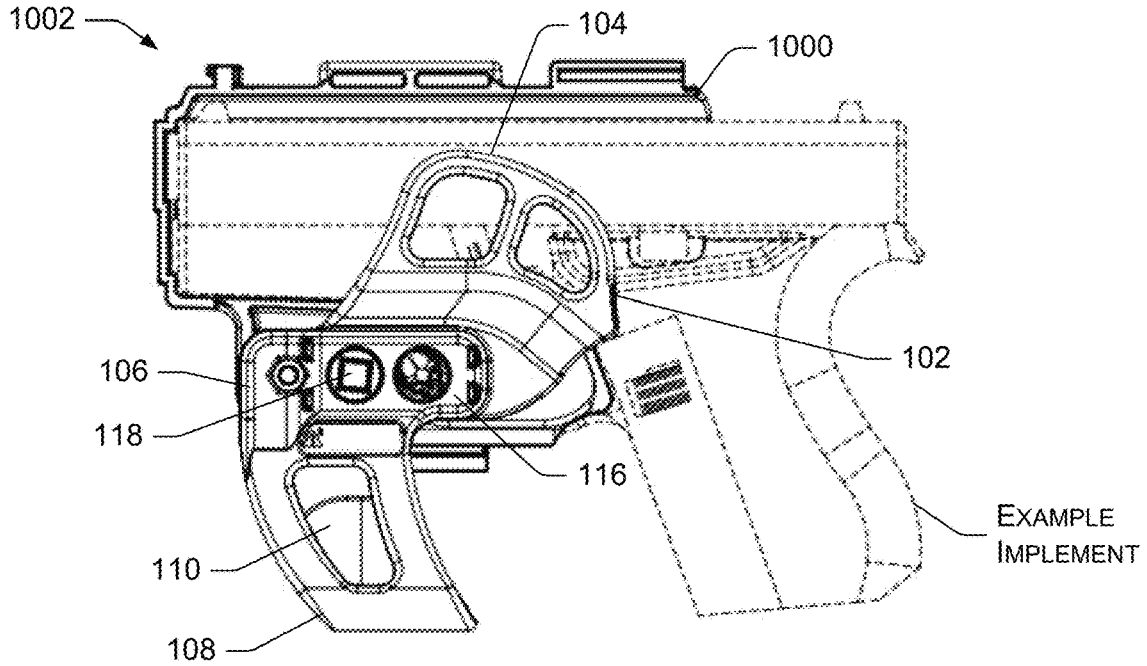
FIGS. 20-21 show two views (profile and perspective views, respectively) of an implement holstered within an example pocket holster assembly with a holster shell, according to an implementation.
Figure 21:
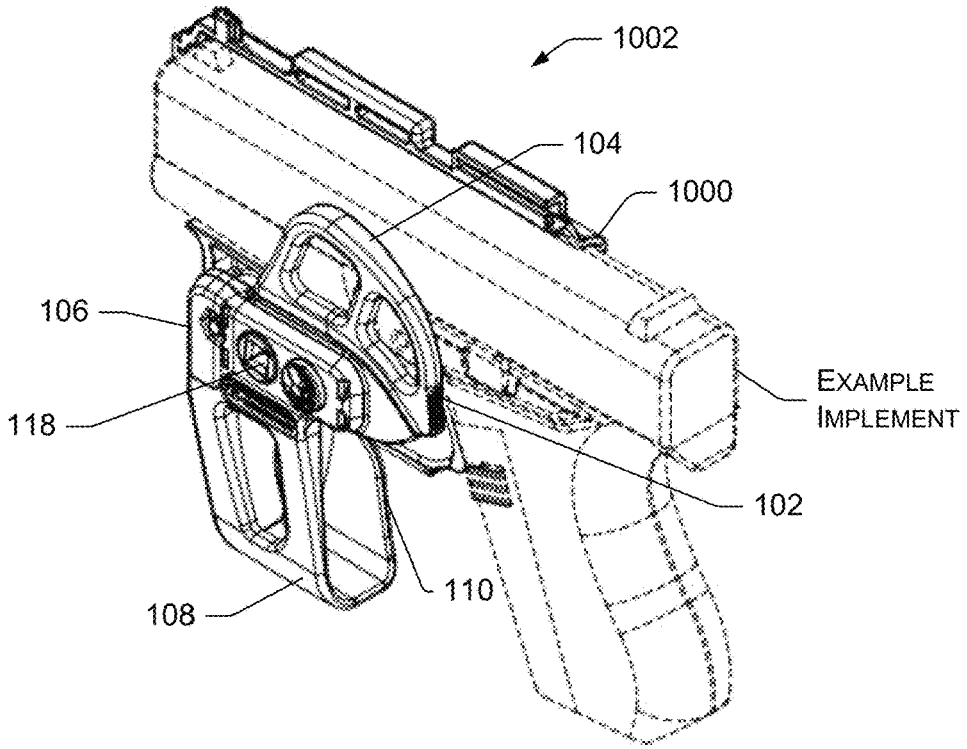
Figure 22:
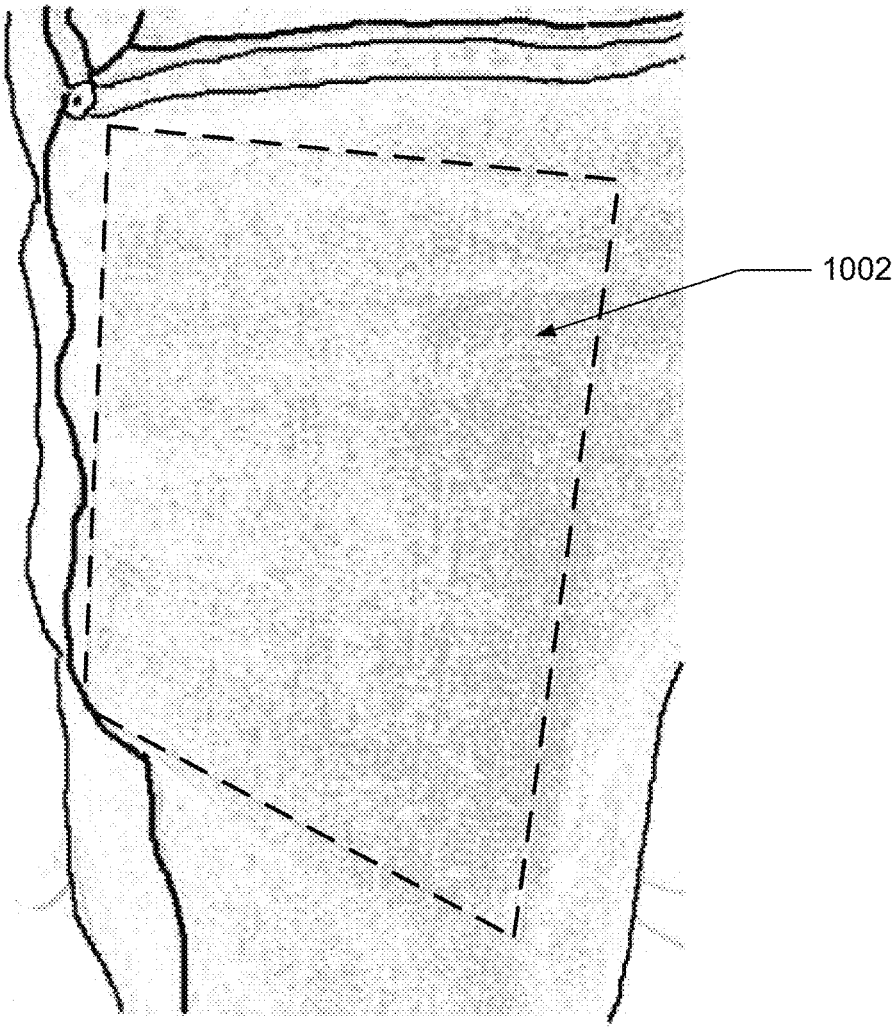
FIG. 22 shows an illustration of an example pocket holster assembly inside a user's pocket, according to an implementation.

FIGS. 1-11 show various views of a pocket holster assembly 100, according to some implementations. FIGS. 12-19 show various views of the assembly 100 coupled to an example carrier 1000. When combined, the assembly 100 and the carrier 1000 comprise an example pocket holster 1002. FIGS. 20 and 21 show an example implement holstered in the pocket holster 1002. FIG. 22 shows an example of a pocket holster 1002 within a pocket of a user, and specifically the generic imprint shown on the user's pocket.

As shown in FIGS. 1-11, an example pocket holster assembly 100 includes a thumb push 102, a cradle 104, a base 106, a hook catch 108, and a concealer hook 110. In alternate implementations, an assembly 100 may comprise fewer, additional, or alternate components, and remain within the scope of the disclosure.

If included, the thumb push 102 comprises a rigid surface or component that can be used to assist in removing the implement from the assembly 100. The thumb push 102 may be coupled to or integral to the cradle 104, to the base 106, or to another component or portion of the assembly 100, in various examples. As such, the thumb push 102 may have a rigid connection or interaction to the cradle 104, to the base 106, or to another component or portion of the assembly 100. The rigid connection or interaction provides that pushing against the thumb push 102 also pushes against (or applies a force against) the cradle 104, the base 106, or another component or portion of the assembly 100.

In alternate embodiments, the thumb push 102 may include some mechanical action to assist in releasing the implement from the assembly 100 or the pocket holster 1002. For example, the action may be applied by pushing the thumb push 102, and may result in the implement being ejected from the assembly 100 by one or more components mechanically coupled to the thumb push 102. A lever action represents one example.

In an embodiment, the thumb push 102 includes distinct features 112, such as ridges, patterns, raised or recessed portions, or the like, on one or more surfaces of the thumb push 102, to help locate the thumb push 102 by feel (for instance, when the assembly 100 is within a pocket).

In an implementation, the cradle 104 is coupled to or integral to the base 106. In various embodiments, the cradle 104 comprises a rigid and substantially planar component, which extends from the base. For instance, in some examples, the cradle 104 is an extension of the base 106, and may extend within a general plane of the base 106.

The cradle 104 can be configured and arranged to assist in guiding the implement as it is holstered and withdrawn. For example, the implement can be slid against the cradle 104 to align the implement to the base 106 of the assembly 100 for holstering the implement. Further, the cradle 104 can be configured and arranged to support the implement while the implement is holstered within the assembly 100. The cradle 104 can be arranged to be disposed against the implement, contacting the implement or nearly contacting the implement, while the implement is holstered, to give support to the implement.

In some embodiments, the cradle 104 may be formed to have one or more bends, grooves, channels, or like features 202. The features 202 may be integral to a shape of the cradle 104, or may be formed within a surface of the cradle 104. The features 202 can be configured to conform to a portion of the implement, to provide a guide to the implement for holstering or withdrawing the implement from the assembly 100. The features 202 may also be used to conform to the implement while the implement is holstered within the assembly 100, for support of the implement.

Figure 2:
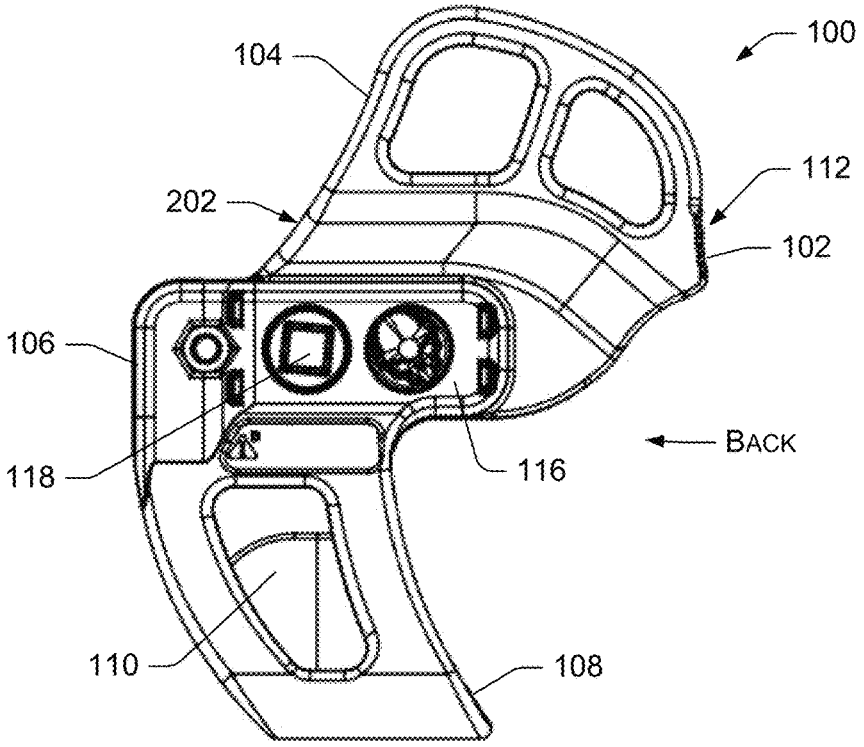
FIGS. 2-4 show three views (outside profile, front, and back views, respectively) of the example pocket holster assembly of FIG. 1, according to an implementation.
Figure 3:
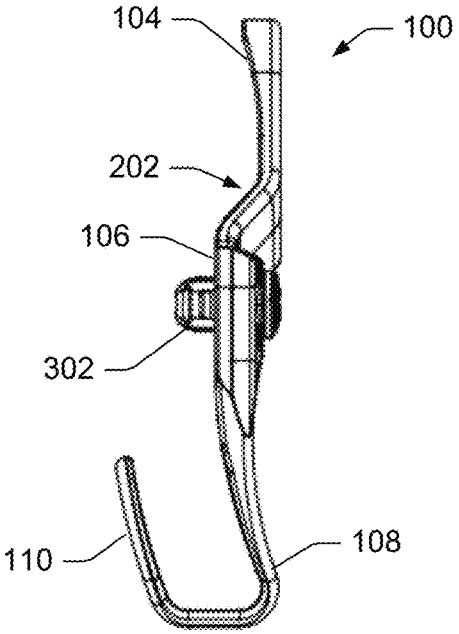
Figure 4:
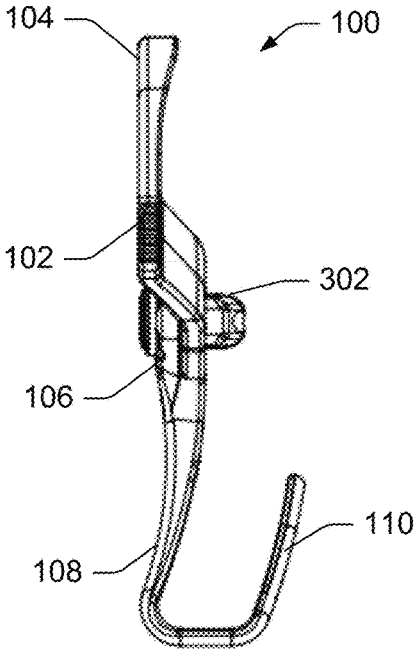
Figure 5:
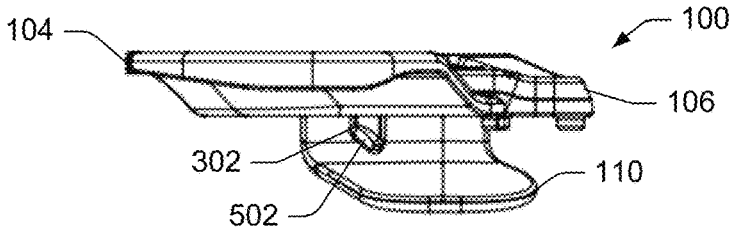
FIGS. 5-7 show three views (top, inside profile, and bottom views, respectively) of the example pocket holster assembly of FIG. 1, according to an implementation.
Figure 6:
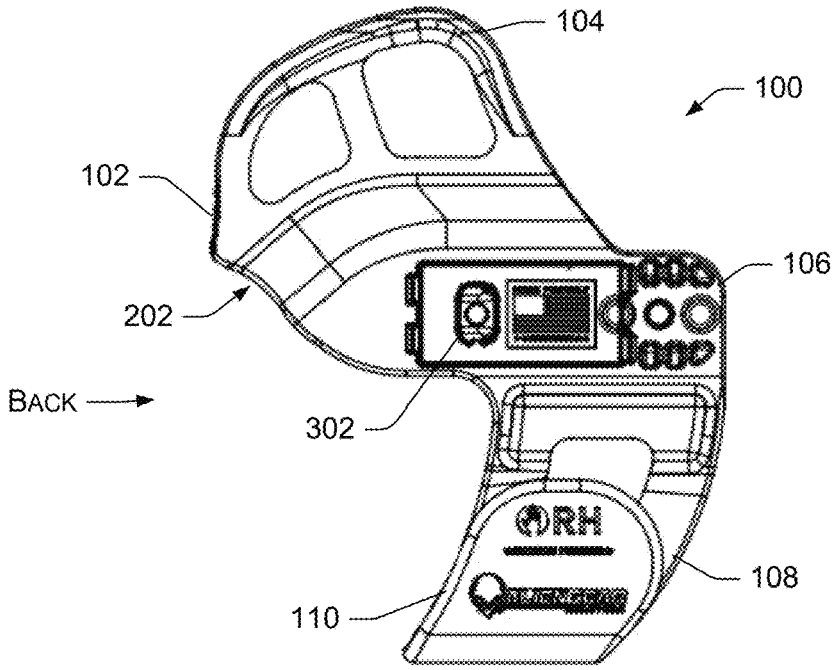
Figure 7:
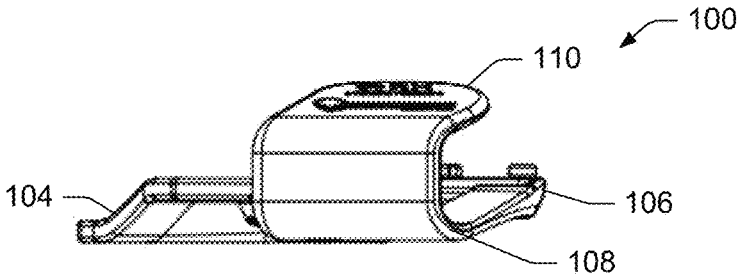
Figure 8:
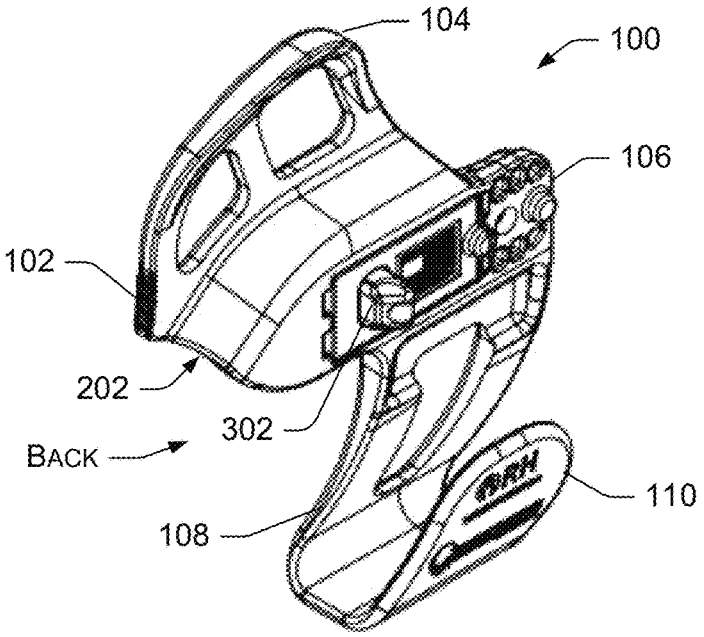
FIGS. 8-9 show two inside perspective views (back and front views, respectively) of the example pocket holster assembly of FIG. 1, according to an implementation.
Figure 9:
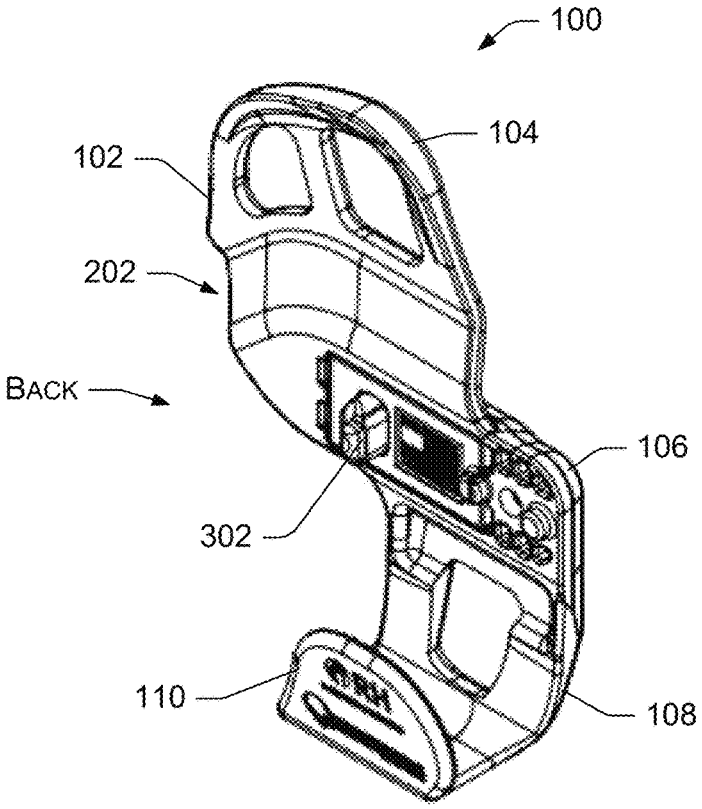

In some embodiments, as shown in FIGS. 1 and 2, a profile of the cradle 104 may be curved, or otherwise formed to have an irregular shape. The curved or irregular profile of the cradle 104 may be used to camouflage the shape of the implement while holstered and within a pocket of the user. In some embodiments, the profile of the cradle 104 may be shaped to resemble some common item that may be carried in a pocket. In other embodiments, the cradle 104 may include one or more openings 114 within a surface of the cradle 104, through the surface of the cradle 104, or the like. The openings 114 may also be shaped to be helpful in camouflaging the shape of the holstered implement.

In various embodiments, the base 106 comprises a rigid planar component, whereupon other components of the assembly 100 are coupled or integrated. The base 106 may be vertically arranged with respect to the implement (parallel to a plane of the implement when holstered), with the cradle 104 extending substantially in a same plane (or a parallel plane) from the base 106.

In an implementation, the base 106 includes a retention component 302 extending substantially normal to the plane of the base 106. The retention component 302 extends inward, toward a holstered implement, so as to engage a portion of the implement while the implement is holstered (e.g., mounted to the assembly 100). In an implementation, the retention component 302 is a passive device, and may be rigid, flexible, spring-loaded, or the like, and/or shaped to keep hold of the portion of the implement until a sufficient force is applied to pull the implement from the assembly 100.

For instance, in various embodiments, the retention component 302 comprises a post, tab, hook, barb, or the like, configured to engage the portion of the implement when the implement is holstered. In an embodiment, the retention component 302 automatically engages the portion of the implement (such as a trigger guard of a handgun, for instance) while the implement is inserted into the assembly 100. For instance, the retention component 302 may include a shaped portion 502, having a wedge, an incline, or other shape arranged to allow the portion of the implement to easily move past the retention component 302 in a first direction (while holstering), and resist movement of the portion of the implement in the opposite direction (when withdrawing). Thus, the retention component 302 can resist the removal of the implement from the assembly 100 until a sufficient force is applied to pull the implement from the assembly 100, such as when a user intentionally withdraws the implement.

In some embodiments, the pocket holster assembly 100 includes a retention mechanism, such as the retention device 116 (or the like) as shown in FIGS. 1-21. In the embodiments, the retention device 116 includes the retention component 302, which is configured and arranged to catch the portion of the implement when the implement is holstered. In an implementation, the retention device 116 provides a base for the retention component 302. In other implementations, the retention device 116 provides tension for the retention component 302. For example, in some embodiments, the retention device 116 provides a spring-loaded tension, a mechanical tension, or the like to the retention component 302.

In some embodiments, the tension of the retention component 302 is adjustable, via the retention device 116. For instance, as shown in FIGS. 1, 2, 10 and 11, the retention device 116 may include a retention adjuster 118 configured to adjust a tension of the retention component 302. In an embodiment, the retention adjuster 118 may be rotated a first direction to increase the tension of the retention component 302 and rotated a second direction to decrease the tension of the retention component 302. Increasing the tension of the retention component 302 (e.g., rotating the retention adjuster 118 the first direction), for instance, may cause the retention component 302 to protrude further from the retention device 116 or the base 106 (and/or increase the spring-loading of the retention component 302), and cause more force to be necessary to remove the implement from the assembly 100. Additionally, the retention component 302 can be retracted into the retention device 116 or the base 106 by reversing the rotation of the retention adjuster 118, which reduces the tension of the retention component 302.

Figure 10:
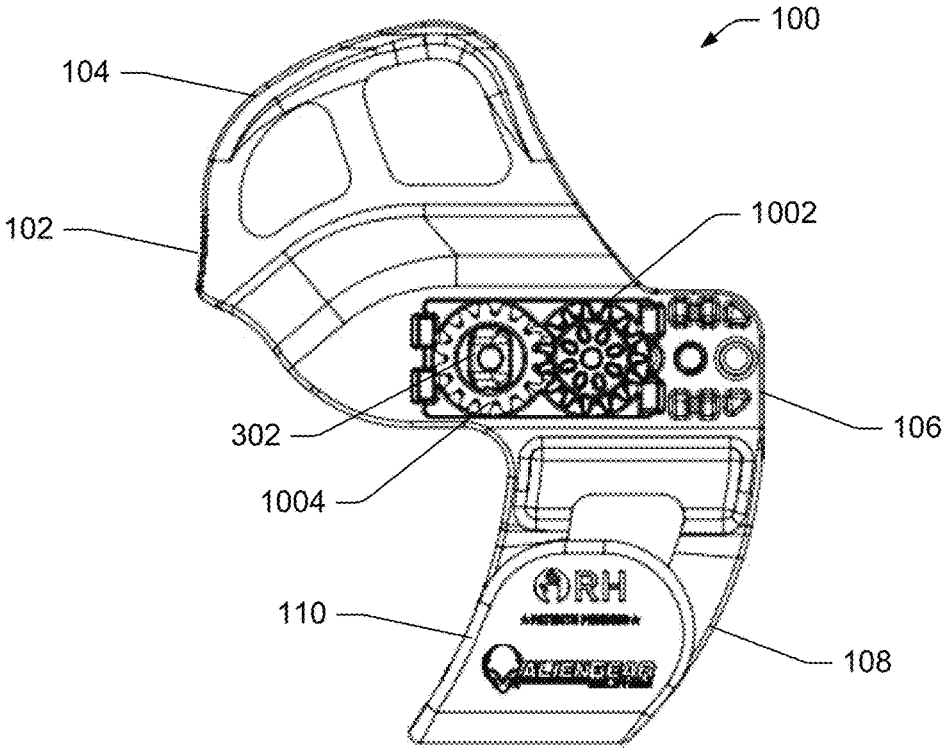
FIGS. 10-11 show two views (inside profile and perspective views, respectively) of an example pocket holster assembly with an adjustable retention mechanism, according to an implementation.
Figure 11:
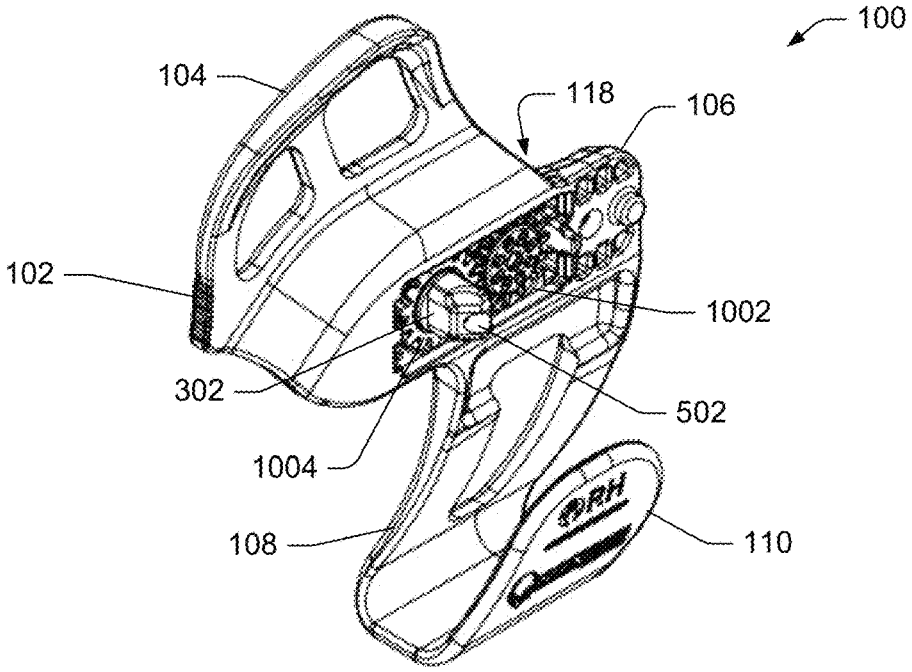
Figure 12:
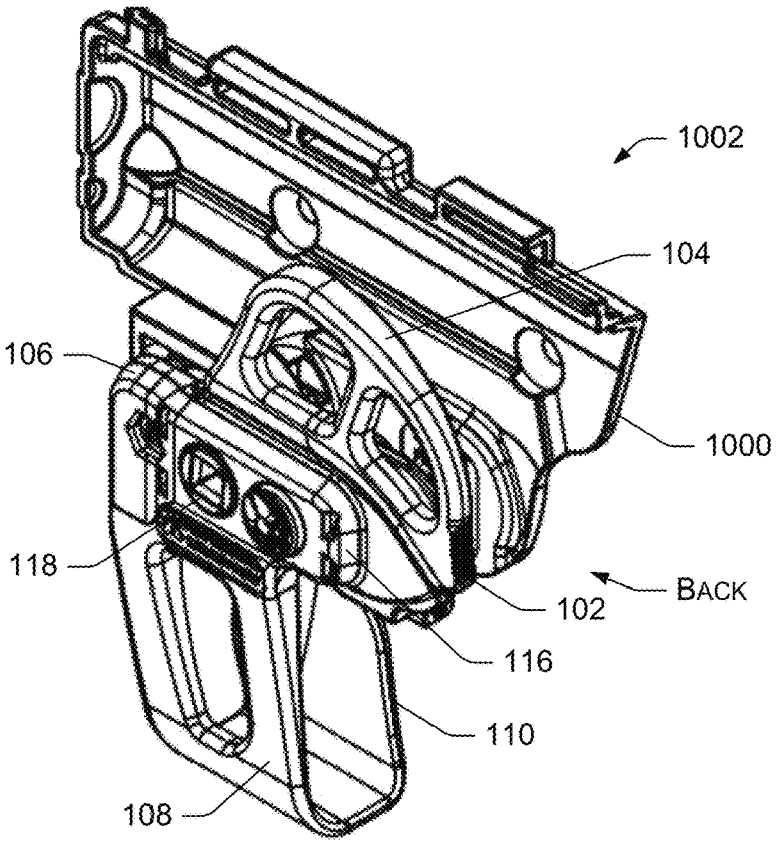
FIGS. 12-13 show two perspective views (inside back and outside front views, respectively) of an example pocket holster assembly with a holster shell, according to an implementation.
Figure 13:
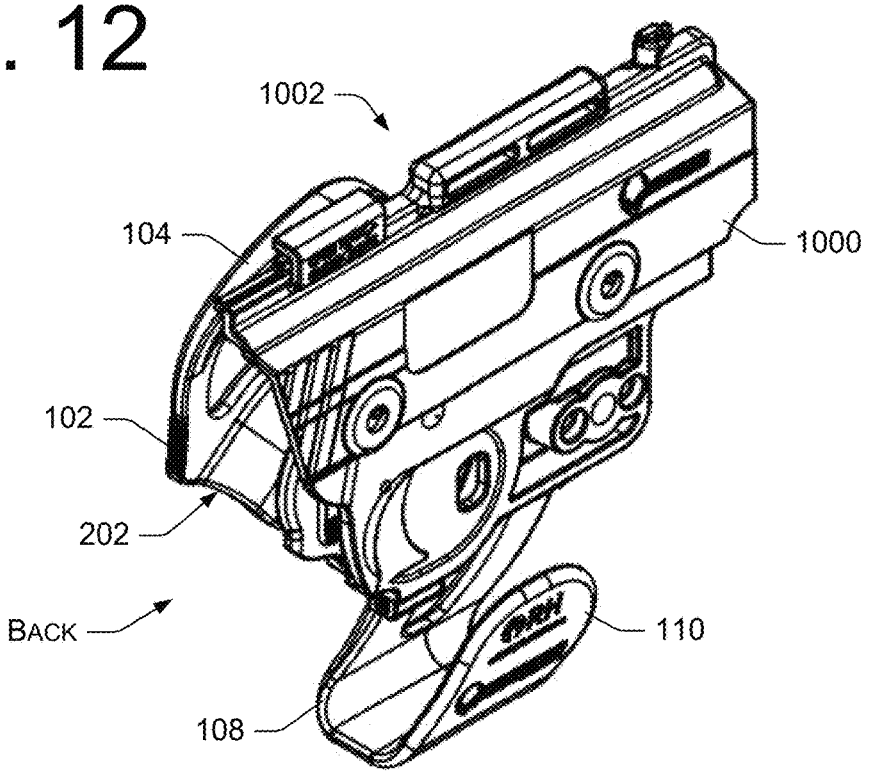
Figure 14:
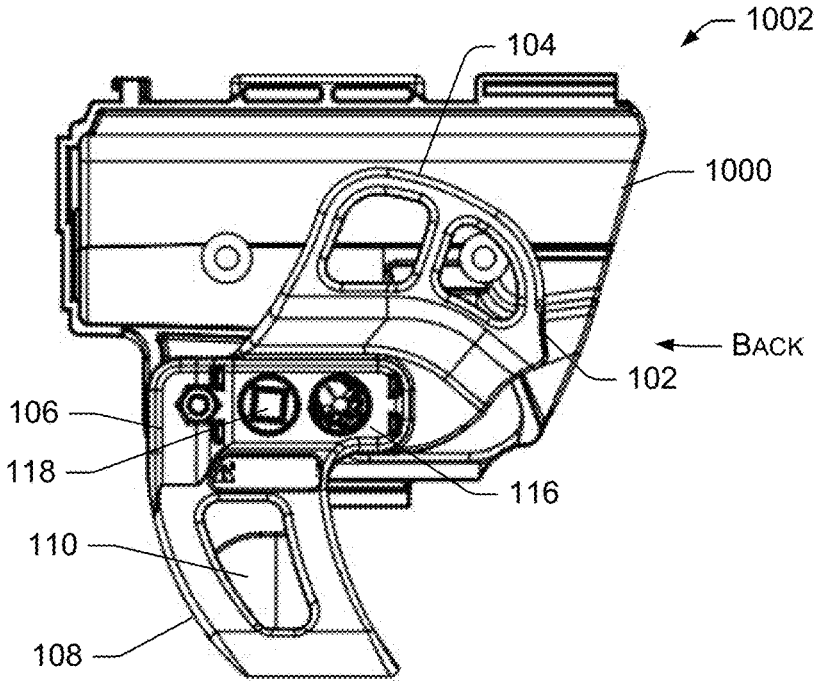
FIGS. 14-16 show three views (outside profile, front, and back views, respectively) of an example pocket holster assembly with a holster shell, according to an implementation.

As shown in FIGS. 10 and 11, in an embodiment, the retention device 116 may include one or more mechanical components to adjust the retention of the assembly 100. For instance, as shown, the reverse side of the retention adjuster 118 may include a gear 1002, configured to mesh with another gear 1004 that is mechanically coupled to the retention component 302. In an embodiment, rotating the retention adjuster 118 rotates the gear 1002, which in turn rotates the gear 1004. In an example, the retention component 302 may be coupled to the gear 1004 with a helix-type connection (or the like), and be restrained from rotating itself, so that rotation of the gear 1004 causes the retention component to move away from or closer to the gear 1004 (e.g., up or down the helix). In other embodiments, other retention adjustment techniques and mechanisms may also be used.

In an implementation, as shown in FIGS. 1-21, the assembly 100 includes a hook catch 108 coupled to or integral to the base 106. The hook catch 108 extends from the base 106 in an orientation that may be substantially coplanar to the base 106, and may be an extension of the base 106. In some examples, the hook catch 108 extends in a different plane, which is at an angle to the plane of the base 106. In various embodiments, the hook catch 108 comprises a rigid component and may include a curved or bent portion configured to catch on the pocket of the user when the assembly 100 is pulled on by the user.

In various embodiments, the hook catch 106 is a safety feature of the assembly 100 or the pocket holster 1002. The hook catch 106 is configured to ensure the assembly 100 or the pocket holster 1002 is not removed from the user's pocket when the implement is withdrawn, including when the user does not push on the thumb push 102 (intentionally or accidentally).

In an implementation, the concealer hook 110 comprises a rigid extension to the pocket holster assembly 100, and can have any of various shapes to provide a generic (or preselected) imprint to camouflage the implement. The concealer hook 110 is coupled to or integral to the hook catch 108, the base 106, or another portion of the assembly 100.

Referring to FIGS. 12-21, in various implementations, the carrier 1000 (i.e., cover) comprises a holster, holster shell, or the like, adapted to encase at least a portion of the implement (such as a handgun, for example). In various other examples, the carrier 1000 may comprise any of various cases, sheaths, containers, enclosures, and the like. In an embodiment, the carrier 1000 comprises a molded shell that resembles a portion of the implement (a handgun, for example).

The carrier 1000 may be removably or permanently coupled to the assembly 100 to form the pocket holster 1002. In some cases, the carrier 1000 may be directly coupled to the assembly 100 via screws, bolts, or other suitable fasteners. In other examples, the carrier 1000 may couple to the assembly 100 by snapping onto a portion of the assembly 100, sliding onto a portion of the assembly 100, or otherwise engaging a portion of the assembly 100.

In one implementation, the carrier 1000 couples to the base 106. In other implementations, the carrier 1000 may couple to other portions or components of the assembly 100. In various embodiments, the carrier 1000 is interchangeable with other carriers 1000, including carriers 1000 with a different size or shape. This allows the assembly 100 to be used with different implements, by interchanging the carrier 1000 with different ones as desired. Multiple carriers 1000 may be configured with a common attachment arrangement (common fastener holes, coupler components, or the like) that fit the base 106 in the same manner, allowing the carriers 1000 to be interchangeable on the base 106.

Figure 15:
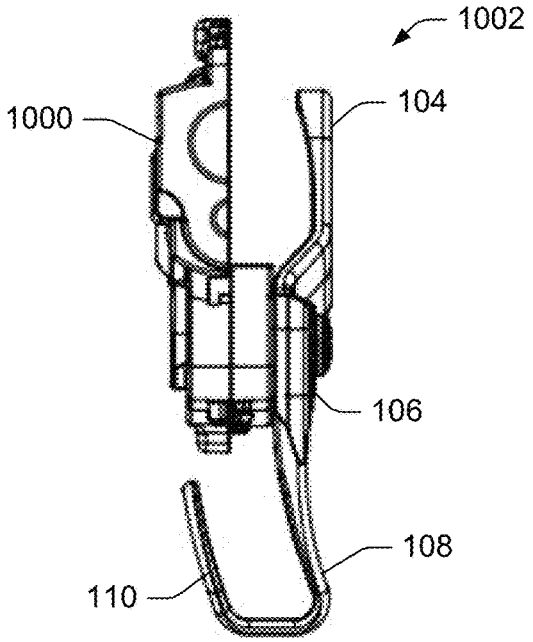
Figure 16:
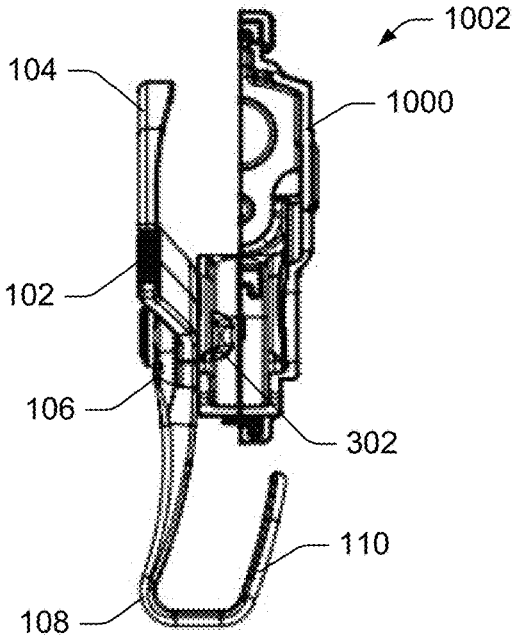
Figure 17:
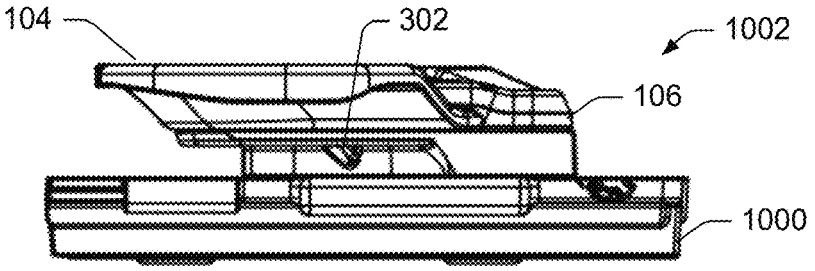
FIGS. 17-19 show three views (top, inside profile, and bottom views, respectively) of an example pocket holster assembly with a holster shell, according to an implementation.
Figure 18:
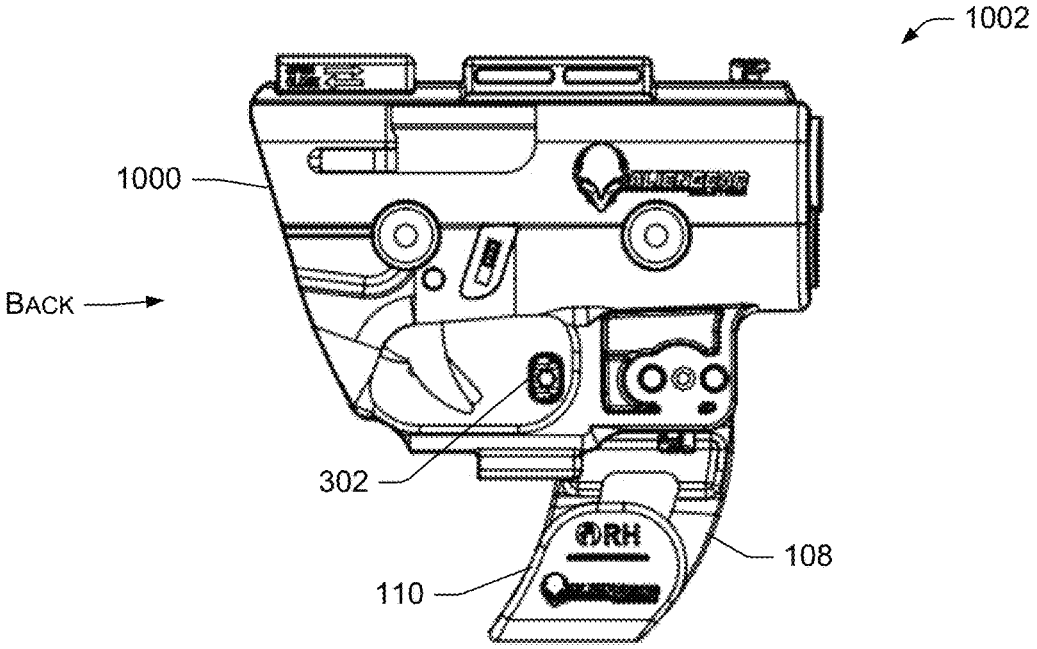
Figure 19:
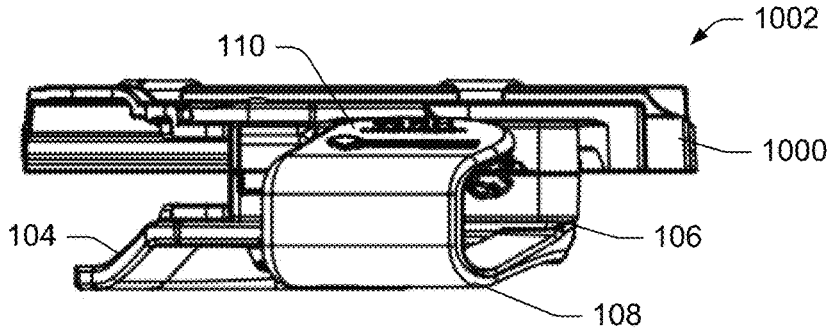

As shown in FIGS. 15 and 16, when coupled to the assembly 100, the carrier 1000 may be substantially parallel to the cradle 104 and the base 106. The carrier 1000 also provides a guide for the implement when holstering the implement, opposite the cradle 104. The carrier 1000 also provides support to the implement when the implement is holstered within the assembly 100.

FIGS. 20 and 21 show an example implement holstered within the assembly 100 and the pocket holster 1002. As shown, the carrier 1000 and/or the cradle 104 support the implement when the implement is holstered. As also shown, the trigger guard of the implement is secured at the base 106. In various embodiments, the trigger guard is secured by a retention component 302, or the like.

Example Operation

In various embodiments, the assembly 100 or the pocket holster 1002 is placed into the user's pocket naturally, with the "back" of the assembly 100 in an upward and/or outward orientation, where it is accessible to the user. The back of the assembly 100 or the pocket holster 1002 is defined as the end having the thumb push 102. The implement may be holstered by putting the implement into the assembly 100 or the pocket holster 1002 while the assembly 100 or the pocket holster 1002 is in the pocket, or while the assembly 100 or the pocket holster 1002 is removed from the pocket. The implement slides into the assembly 100 or the pocket holster 1002 from the back of the assembly 100 or the pocket holster 1002, and may automatically engage a retention component 302, if included.

To withdraw the implement from the assembly 100 or the pocket holster 1002, the user locates the implement by hand, then pulls the implement from the assembly 100 or the pocket holster 1002, again from the back of the assembly 100 or the pocket holster 1002.

In one example, the user may push on the thumb push 102 (e.g., with the user's thumb) while pulling on the implement, to separate the implement from the assembly 100 or the pocket holster 1002. In an example, the thumb push 102 may be rigidly coupled to the assembly 100 or the pocket holster 1002, providing a firm surface to push against while pulling the implement.

In the example, the thumb push 102 is designed to ensure a safe draw of the implement, while keeping the assembly 100 or the pocket holster 1002 inside the user's pocket. Often with other holster designs, the holster can come out of the user's pocket when the implement is withdrawn, and either falls to the ground, or remains attached to the implement. Either case can be problematic, particularly in urgent situations. The thumb push 102 ensures a quicker draw, with safer and more reliable results, since the assembly 100 or the pocket holster 1002 remains in the user's pocket and the implement is safely separated from the assembly 100 or the pocket holster 1002.

In another example, the user may withdraw the implement from the assembly 100 or the pocket holster 1002 by locating the implement by hand, and pulling on the implement (with or without engaging the thumb push 102). In the example, the hook catch 108 catches on the pocket of the user's clothing, trapping the assembly 100 or the pocket holster 1002, and keeping the assembly 100 or the pocket holster 1002 inside the user's pocket while the implement is withdrawn.

In various embodiments, the hook catch 108 may have various shapes adapted to catch the inside of the user's pocket when the hook catch 108 is pulled upwards and/or outwards towards the opening of the pocket. For instance, the hook catch 108 may have an angled shape, a curved shape, a hooked shape, and so forth. In some cases, the user may pull the implement at a particular angle, or the like, with respect to the user's pocket, to cause or to ensure that the hook catch 108 will catch on the user's pocket when the implement is withdrawn.

To remove the assembly 100 or the pocket holster 1002 from the user's pocket (with or without the implement holstered), the user can tilt, angle, turn, or otherwise purposefully orient the assembly 100 or the pocket holster 1002 while pulling on assembly 100 or the pocket holster 1002 to prevent the hook catch 108 from catching on the user's pocket.

Referring to FIGS. 20-22, one common problem with carrying an implement such as a handgun in a user's pocket, is that the shape of the implement can show through the pocket, making it obvious that the user is carrying the implement. In an implementation, as shown in FIGS. 20-22, the pocket holster 1002 can be configured to leave a generic imprint on the user's pocket, for carrying the implement in a concealed manner.

For instance, the shape of the concealer hook 110 (along with the shape of the carrier 1000 and/or the shape of the cradle 104, for example) can provide a camouflage for the shape of the implement, making it less obvious that the implement is carried in the user's pocket. As shown in FIG. 22, instead of the shape of the implement, a generic shape, such as a rectangular shape, or the like, or a preselected shape shows through the user's pocket.

In various implementations, one or more of the thumb push 102, the cradle 104, the base 106, the hook catch 108, and/or the concealer hook 110 are comprised of one of various plastics, or the like. For example, the thumb push 102, the cradle 104, the base 106, the hook catch 108, and/or the concealer hook 110 may be comprised of a thermoplastic elastomer (TPE), or similar material. In an embodiment, the carrier 1000 is also comprised of a TPE or similar material. In an alternate embodiment, the carrier 1000 is comprised of a natural or synthetic leather, or the like. In alternate implementations, the thumb push 102, the cradle 104, the base 106, the hook catch 108, the concealer hook 110 and/or the carrier 1000 may be comprised other materials (e.g., composites, metal, etc.) or a combination of materials.

The use of an injection molded TPE for components of the assembly 100 or the pocket holster 1002 provides rigid and stable components for drawing and re-holstering the implement, for instance. In various embodiments, the thumb push 102, the cradle 104, the base 106, the hook catch 108, the concealer hook 110 and/or the carrier 1000 have flexibility and stability properties based on a particular material selected and a thickness of the thumb push 102, the cradle 104, the base 106, the hook catch 108, the concealer hook 110 and/or the carrier 1000.

Some TPE materials that may be used to form assembly 100 components include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, combinations of the same, and the like.

In an implementation, the thumb push 102, the cradle 104, the base 106, the hook catch 108, and/or the concealer hook 110 are partially or fully formed using an injection molding process. Accordingly, the thumb push 102, the cradle 104, the base 106, the hook catch 108, and/or the concealer hook 110 can be custom molded as desired for the user and/or as needed for holstering an implement, such as the example implement of FIGS. 20 and 21, for instance. In alternate implementations, one or more of the thumb push 102, the cradle 104, the base 106, the hook catch 108, and/or the concealer hook 110 are formed by some other process (e.g., stamping, cutting, etc.).

In an implementation, the carrier 1000 comprises a removable, modular plastic shell section formed using an injection molding process to conform to the shape of at least a portion of the implement. Further, in various embodiments, the thumb push 102, the cradle 104, the base 106, the hook catch 108, and/or the concealer hook 110 are custom molded to at least partially conform to the implement. For example, the thumb push 102, the cradle 104, the base 106, the hook catch 108, and/or the concealer hook 110 may be molded in various shapes and sizes to accommodate a particular implement, or a range of implements. For example, the thumb push 102, the cradle 104, the base 106, the hook catch 108, and/or the concealer hook 110 may be shaped and sized to accommodate a particular model of handgun, or a series of handguns.

In various implementations, an assembly 100 may include additional or alternate components, or have different shapes or sizes than those illustrated. The assembly 100 components disclosed herein have been illustrated to be used with handgun holsters and holster shells. However, the assembly 100 components disclosed herein may also be used with the holders or cases of any tools or implements.

The pocket holster assembly 100 and the pocket holster 1002 are discussed in terms of securing an implement, but either may be used to secure or mount any of various items, where concealed carry on a body of the user are desired. Although various implementations and examples are discussed herein, further implementations and examples may be possible by combining the features and elements of individual implementations and examples.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A holster assembly for carrying an implement in a pocket of a user, comprising:

a planar base configured to engage a portion of an implement to mount the implement to the holster assembly;

a hook catch coupled to or integral to the base, having a planar portion extending from the base, and including a hooked or looped portion at an end of the planar portion, configured to catch on a pocket of a user when the implement is withdrawn from the holster assembly;

a concealer hook coupled to or integral to the hook catch, having a planar portion configured to form a predetermined shape on the pocket of the user while the holster assembly is within the pocket of the user to camouflage a shape of the holster assembly; and a rigid thumb push coupled to or integral to the base, extending from the base, and including a rigid surface, whereby pushing against the rigid surface while pulling the implement disengages the implement from the base.

2. The holster assembly of claim 1, further comprising a holster portion including a cover coupled to the base and configured to enclose at least a portion of the implement while the base is engaged with the portion of the implement.

3. The holster assembly of claim 2, wherein the cover is removably coupled to the base, and wherein the cover is interchangeable at the base with one or more other covers having a different size or shape from the cover, and wherein the base is configured to be coupled to any of a plurality of covers, including the cover and the one or more other covers.

4. The holster assembly of claim 1, further comprising a retention component protruding from a portion of the base and adapted to engage the portion of the implement while the implement is mounted to the holster assembly, to retain the implement to the holster assembly.

5. The holster assembly of claim 4, wherein the retention component is configured to engage a trigger guard of a handgun when the handgun is mounted to the holster assembly, and to resist removal of the handgun from the holster assembly until a sufficient force is applied to overcome a tension of the retention component.

6. The holster assembly of claim 4, wherein the retention component is adjustable in tension and/or protrusion length, to adjust a retention of the implement to the holster assembly.

7. The holster assembly of claim 4, further comprising a retention adjuster, wherein moving the retention adjuster a first direction extends the retention component relative to the base and moving the retention adjuster a second direction retracts the retention component relative to the base.

8. The holster assembly of claim 1, further comprising a rigid cradle coupled to or integral to the base, and extending from the base parallel to a plane of the base.

9. The holster assembly of claim 8, wherein the cradle comprises a guide for the implement to align the implement to the base while mounting the implement to the holster assembly.

10. The holster assembly of claim 8, wherein the cradle comprises a support for the implement while the implement is mounted to the holster assembly.

11. The holster assembly of claim 8, wherein the cradle includes a curved or irregular profile to camouflage a shape of the holster assembly when the holster assembly is within the pocket of the user.

12. The holster assembly of claim 1, wherein the concealer hook is shaped to form a rectangular imprint on the pocket of the user while the holster assembly is within the pocket of the user, to conceal a shape of the implement.

13. The holster assembly of claim 1, wherein the thumb push includes ridges, patterns, raised portions, and/or recessed portions on the rigid surface of the thumb push.

14. A holster assembly for carrying an implement in a pocket of a user, comprising:

a planar base configured to interface with a portion of an implement to mount the implement to the holster assembly;

a retention component protruding from a surface of the base, normal to the surface of the base, and adapted to engage the portion of the implement to retain the implement to the holster assembly;

a hook catch coupled to or integral to the base, having a planar portion extending from the base, and including a hooked or looped portion at an end of the planar portion, configured to catch on a pocket of a user when the implement is withdrawn from the holster assembly;

a concealer hook coupled to or integral to the hook catch, having a planar portion configured to form a predetermined shape on the pocket of the user while the holster assembly is within the pocket of the user to camouflage a shape of the holster assembly;

a rigid cradle coupled to or integral to the base, and extending from the base parallel to a plane of the base and in a direction opposite to the hook catch; and a rigid thumb push coupled to or integral to the cradle, and including a rigid surface, whereby pushing against the rigid surface while pulling the implement disengages the implement from the base.

15. The holster assembly of claim 14, further comprising a holster portion including a cover removably coupled to the base and configured to enclose at least a portion of the implement while the base is engaged with the portion of the implement.

16. The holster assembly of claim 14, further comprising a rigid cradle coupled to or integral to the base, the cradle comprising a guide for the implement to align the implement to the base while mounting the implement to the holster assembly.

17. The holster assembly of claim 14, further comprising a retention device coupled to or integral to the base, the retention device moveably coupled to the retention component and including a retention adjuster, wherein moving the retention adjuster a first direction extends the retention component relative to the base and moving the retention adjuster a second direction retracts the retention component relative to the base.

18. A holster assembly for carrying an implement in a pocket of a user, comprising:

a planar base having a protrusion configured to engage a portion of an implement to mount the implement to the holster assembly;

a cover removably coupled to the base and configured to enclose at least a portion of the implement while the base is engaged with the portion of the implement;

a hook catch coupled to or integral to the base, having a planar portion extending from the base, and including a hooked or looped portion at an end of the planar portion, configured to catch on a pocket of a user when the implement is withdrawn from the holster assembly;

a concealer hook coupled to or integral to the hook catch, having a planar portion configured to form a predetermined shape on the pocket of the user while the holster assembly is within the pocket of the user to camouflage a shape of the holster assembly; and a rigid thumb push coupled to or integral to the base, extending from the base, and including a rigid surface, whereby pushing against the rigid surface while pulling the implement disengages the implement from the base.

19. The holster assembly of claim 18, further comprising a rigid cradle coupled to or integral to the base, the cradle extending substantially parallel to a plane of the cover.

20. The holster assembly of claim 18, wherein the cradle and the cover comprise a guide for the implement to align the implement while mounting the implement to the holster assembly.

* * * * *